US010676926B2

(12) United States Patent
Kooistra

(10) Patent No.: US 10,676,926 B2
(45) Date of Patent: Jun. 9, 2020

(54) DEVICE AND METHOD FOR ADHERING BRICK SLIPS TO A PANEL

(71) Applicant: ACQUIES HOLDING BV, Bolsward (NL)

(72) Inventor: Murk Anne Kooistra, Bolsward (NL)

(73) Assignee: ACQUIES HOLDING B.V., Bolsward (NL)

( * ) Notice: Subject to any disclaimer, the term of this patent is extended or adjusted under 35 U.S.C. 154(b) by 14 days.

(21) Appl. No.: 16/302,281

(22) PCT Filed: May 17, 2017

(86) PCT No.: PCT/NL2017/050307
§ 371 (c)(1),
(2) Date: Nov. 16, 2018

(87) PCT Pub. No.: WO2017/200378
PCT Pub. Date: Nov. 23, 2017

(65) Prior Publication Data

US 2019/0211555 A1 Jul. 11, 2019

(30) Foreign Application Priority Data

May 18, 2016 (NL) ..... 2016791

(51) Int. Cl.
*E04C 2/04* (2006.01)
*E04G 21/22* (2006.01)

(52) U.S. Cl.
CPC ..... *E04C 2/042* (2013.01); *E04G 21/22* (2013.01)

(58) Field of Classification Search
CPC ..... E04G 21/22; E04C 2/042
See application file for complete search history.

(56) References Cited

U.S. PATENT DOCUMENTS 2,599,552 A * 6/1952 Harney ..... E04G 21/22 52/749.14
3,203,069 A * 8/1965 Wogulis ..... E04C 2/042 425/123

(Continued)

FOREIGN PATENT DOCUMENTS

DE 1 807 883 6/1970
EP 1 977 058 7/2014

OTHER PUBLICATIONS

International Search Report for PCT/NL2017/050307, dated Sep. 11, 2017. (2 pages).

(Continued)

*Primary Examiner* — Andrew J Triggs
(74) *Attorney, Agent, or Firm* — Nixon & Vanderhye P.C.

(57) ABSTRACT

The invention relates to a device for adhering brick slips to a panel, which device comprises: —a horizontal transport surface with an infeed side and an outfeed side for transporting the panel from the infeed side, over the transport surface and to the outfeed side; —a buffer arranged adjacently of the transport surface for buffering at least one row of brick slips; —dispensing means for dispensing a layer of adhesive onto the panel; and —engaging means displaceable between a position above the buffer and a position above the transport surface for picking up from the buffer the at least one row of brick slips and placing the row of brick slips on the panel.

15 Claims, 3 Drawing Sheets

(56) References Cited

U.S. PATENT DOCUMENTS 3,382,640 A * 5/1968 Thomas ..... E04G 21/22 52/749.14
3,629,384 A * 12/1971 Elgenstierna ..... B28B 19/0053 264/130
3,755,521 A * 8/1973 Young ..... B28B 19/0053 264/69
3,789,101 A * 1/1974 Wright ..... E04C 2/041 264/261
3,790,428 A * 2/1974 Lingl ..... E04C 2/042 156/559
3,849,228 A * 11/1974 Lingl ..... E04C 2/042 156/297
3,881,981 A * 5/1975 Lingl ..... B28B 19/0053 156/297
3,930,929 A * 1/1976 Lingl ..... E04C 2/042 156/558
3,936,333 A * 2/1976 Behunin ..... E04C 2/042 156/60
4,106,259 A 8/1978 Taylor-Smith
5,016,419 A * 5/1991 Boot ..... E04C 2/042 156/182
5,366,066 A * 11/1994 Boot ..... E04C 2/042 198/458
RE35,942 E * 11/1998 Boot ..... E04C 2/042 52/749.14
7,111,437 B2 * 9/2006 Ainedter ..... B28B 11/00 156/579
2003/0229998 A1 * 12/2003 Ainedter ..... B28B 11/00 33/410
2006/0260264 A1 * 11/2006 Reynolds ..... E01C 5/00 52/745.1
2014/0069050 A1 3/2014 Bolin
2019/0211555 A1 * 7/2019 Kooistra ..... E04C 2/042

OTHER PUBLICATIONS

Written Opinion of the ISA for PCT/NL2017/050307, dated Sep. 11, 2017. (7 pages).

* cited by examiner

DEVICE AND METHOD FOR ADHERING BRICK SLIPS TO A PANEL

This application is the U.S. national phase of International Application No. PCT/NL2017/050307 filed May 17, 2017 which designated the U.S. and claims priority to NL Application No. 2016791 filed May 18, 2016, the entire contents of each of which are hereby incorporated by reference.

The invention relates to a device for adhering brick slips to a panel, such as an outer wall panel.

In house building a wall is traditionally constructed from an inner leaf and an outer leaf with a cavity therebetween in which an insulating layer can be arranged. The inner leaf and outer leaf can be formed from laid blocks or bricks, although it is also common nowadays to embody the inner leaf as a concrete slab, which is usually manufactured in a factory. In this latter case the manufactured concrete slab is transported to the construction site, erected there, after which the insulating layer is arranged and the brickwork of the outer leaf is laid.

Various devices which can construct a wall automatically are known for laying the brickwork of walls. The publications EP1977058 and U.S. Pat. No. 7,111,437 describe a device with which walls can be constructed automatically by placing several rows of bricks on another wherein the bricks are glued to each other by means of mortar. These walls are constructed at the construction site because brick walls usually cannot be transported.

House building has developed further, and the outer leaf is nowadays also manufactured in a factory and transported to the construction site as a whole because such outer leaves are provided with reinforcing constructions. What also happens is that a whole outer wall, i.e. inner leaf, insulating layer and outer leaf, is produced integrally.

These developments have also given rise to the covering of a panel of insulating material with brick slips. Such a panel can be placed as outer leaf against the inner leaf. The brick slips then give the house the appearance of the outer leaf consisting of laid bricks. An additional advantage of the brick slips is that they are thinner than usual bricks, whereby the insulating layer can take a thicker form while maintaining the same final thickness for a wall.

In addition, it is difficult to insulate existing walls again in the renovation of old houses and buildings. In order to still obtain a good insulation, it is known to demolish the outer leaves of an existing building and then rebuild the outer leaves with a better insulation. Panels of insulating materials covered with brick slips can then also be used here.

Arranging of these brick slips on the insulating layer is currently still done manually, in the same way as brick slips would be arranged on walls of existing houses. The panels are thus smeared with an adhesive and the brick slips are arranged manually on the panels in a random order. The quality of these panels is not constant, whereby this manner of arranging brick slips on a panel is not optimal for serial production.

In addition, the speed of the adhering of brick slips to the panel is relatively low because each brick slip has to be handled individually. This also contributes to variations in the positioning of the brick slips on the panel.

It is therefore an object of the invention to reduce or even obviate the above stated drawbacks.

This object is achieved with a device for adhering brick slips to a panel, which device comprises:

a horizontal transport surface with an infeed side and an outfeed side for transporting the panel from the infeed side, over the transport surface and to the outfeed side, the transport surface having a longitudinal dimension extending along the direction of transporting from the infeed side to the outfeed side and having a transverse dimension perpendicular to the longitudinal dimension;

a buffer arranged adjacently of the transport surface for buffering at least one row of brick slips; and engaging means displaceable between a position above the buffer and a position above the transport surface capable of picking up from the buffer the at least one row of brick slips and placing the row of brick slips on the panel, wherein the engaging means 1) comprise a plurality of brick slip grippers, wherein a brick slip gripper is a gripper capable of holding a brick slip;

2) are displaceable above the horizontal transport surface in the transverse dimension of the horizontal transport surface so that the device is capable of placing a first row of brick slips on the panel and also capable of placing at least a second row of brick slips on the panel, wherein the second row is adjacent to the first row;

wherein the device comprises means for adjusting the joint widths of the brick slips in a row of brick slips from a first joint width to a second joint width.

In a device of the invention, the horizontal transport surface allows the transport of the panel on which the brick slips are to be placed. It has a side for feeding the panel into the device (the infeed side) and a side for feeding the panel out of the device (the outfeed side), the latter typically occurring when the panel is covered with brick slips. The infeed side and the outfeed side are usually on opposite sides of the device, but they may also occur on the same side of the device, in which case they coincide.

The direction in which a panel moves during the feeding (including the direction opposite thereto) defines the longitudinal dimension of the transport surface. Perpendicular to this dimension is the transverse dimension. In a device of the invention, the transverse dimension of the transport surface is typically at least one meter, i.e. the transport surface can accommodate (and thus transport) a panel having one dimension (width) that is at least one meter. There is in principle no restriction to the length of a panel that can be accommodated by the horizontal transport surface. Usually, the transverse dimension is in the range of 1-6 meters, preferably it is in the range of 2-4 meters.

In a device of the invention, the horizontal transport surface and the buffer are adjacent of each other, typically in a way that their interface (in particular a straight interface) extends in the longitudinal dimension. The feeding of a panel in the device then occurs parallel to the interface.

In the device according to the invention a panel of for instance an insulating foam is transported over the horizontal transport surface and positioned at a desired position, for instance by having the panel hit a stop. A row of brick slips is then placed ready for use in the buffer, which brick slips can be picked up by means of the engaging means. The engaging means are then carried from the position above a buffer to a position above the transport surface so that the row of brick slips can be placed on the panel in a layer of applied adhesive. The placing typically occurs along the longitudinal dimension of the transport surface.

The steps of picking up a row of brick slips from the buffer and placing the row on the panel adjacent to the previously placed row can be repeated a plurality of times. Accordingly, a device of the invention is capable of placing a first row of brick slips on the panel followed by placing at least a second row of brick slips on the panel. Typically, a device of the invention is capable of placing at least ten adjacent rows of brick slips on the panel.

Thus, the process of covering the panel with brick slips typically occurs in the transverse direction of the transport surface (and of the panel). It then usually starts at the side of the panel that is at the interface between the buffer and the transport surface, but it may also start on the opposite side (most remote from the interface). It may also leave open spaces between rows, which may for example be covered by brick slips of another type at a later stage.

For each row to be placed, the engaging means are carried from a position above the buffer to a position above the transport surface, which latter position is different for each different row to be placed. Thus, the engaging means (and thus the brick slip grippers) can be positioned on any point along the transverse dimension of the horizontal transport surface.

Rows of brick slips may be picked up from one position of the buffer, but also from different positions of the buffer, for example when a plurality of parallel rows is buffered in the buffer.

Depending on the adhesive, it is possible to smear the adhesive over the whole panel first and then slide the panel under the engaging means for arranging the brick slips or, in the case of quick-drying adhesive, to carry out the application of the adhesive in parts at the same time as the arranging of the brick slips.

Adhesive can be applied to a panel over the whole surface area (i.e. surface is continuously covered) or partially (i.e. surface is partially covered).

Because a row of brick slips is each time picked up out of the buffer from a fixed position with the device, the row of brick slips can then be adhered to the panel at a desired position in precise manner. It is hereby possible to adhere brick slips over the whole panel in automated manner and with high precision. A gain in speed is in addition obtained in that a whole row of brick slips is adhered to the panel in one operation.

Dispensing means are preferably provided for dispensing a layer of adhesive onto the panel, so that covering of a panel can be performed fully automatically.

It is particularly in the case of partial adhesion that the dispensing means provide advantages, since this can take place accurately and with great reproducibility. The adhesive can also be applied in different patterns. It can for instance be applied in continuous lines, at a right angle to the bed joints (brick direction). This provides for a good downward discharge of condensed water when the panel is placed vertically. It can also be applied in the direction of the bed joint, which achieves that the adhesive under each row of brick slips has had the same amount of time to cure. Yet another manner of application is the so-called dotted manner: one or more small lines of adhesive are provided for each brick slip.

It is also possible for the dispensing means to apply the correct number of dots at the correct locations for each brick slip if brick slips with different sizes are used (for instance whole, half or quarter bricks). Coordinating the application location of the adhesive with the brick size has the advantage that there is no adhesive under the joints, whereby less adhesive is used.

In a particular embodiment of the dotted application the adhesive is applied in short lines having a slight slope, so that condensed water can easily run down therefrom.

A preferred embodiment of the device according to the invention further comprises a gantry guide extending over the buffer and the transport surface and wherein the engaging means are arranged on the gantry guide.

The engaging means can be positioned above the buffer and the transport surface in precise and reliable manner via the gantry guide, so that the rows of brick slips can be arranged on a panel in precise manner.

The drive of the movement of the engaging means along the gantry guide can for instance be provided with servomotors and position sensors, so that a control can easily control the device.

In a preferred embodiment of the device according to the invention the engaging means comprises a row of suction nozzles for engaging a brick slip by means of suction. For example, the brick slip grippers comprise suction nozzles for holding a brick slip by means of suction.

An advantage of the suction nozzles is that the brick slips can lie against each other and can then still be picked up. If grippers were for instance used, the brick slips would need to have at least a mutual distance equal to or greater than the thickness of the grippers.

It is particularly in the case of brick slips with a flat surface that these slips can be easily picked up with a suction nozzle. By choosing a suitable material for the suction nozzle in combination with a determined amount of underpressure in the suction nozzle it is moreover possible to pick up brick slips with a rougher surface and/or porous surface using a suction nozzle. A restriction or valve is preferably arranged in the suction nozzles in order to prevent that, if a suction nozzle is not closed, all the underpressure escapes via this suction nozzle which is not closed.

When the row of brick slips is positioned above the panel, the suction nozzles can moreover be used to press the brick slips into the layer of adhesive. The engagement on the brick slips can further be released in simple manner by discontinuing the suction.

In yet another embodiment of the device according to the invention the engaging means comprise a driven adjusting mechanism for adjusting the pitch distance of the suction nozzles from a first pitch distance to a second pitch distance during displacement of the row of bricks slips from the buffer to the panel. With this adjusting mechanism it is also possible to ensure that the suction nozzles are correctly positioned during the engaging on the brick slips and do not for instance engage on a transition between two adjacent brick slips.

In particular, the engaging means may comprise a driven adjusting mechanism capable of displacing the brick slip grippers independently of each other, so that the distance between the brick slip grippers can be adjusted. Usually, the brick slip grippers are then displaced along the longitudinal dimension of the transport surface, Also, the adjusting of the distance between the brick slip grippers usually concerns adjusting the pitch distance of the brick slip grippers from a first pitch distance to a second pitch distance. The adjusting of the distance between the brick slip grippers may occur during displacement of the row of bricks slip grippers from the buffer to the panel (which is typically in the air). Alternatively, it may occur before the displacement from the buffer to the panel.

The driven adjusting mechanism may in particular comprise a multi-scissor construction comprising a plurality of pivot points, wherein the brick slip grippers are mounted on the pivot points, so that the distance between brick slip grippers can be adjusted by driving the multi-scissor construction. In such structure, the pivot points are aligned, and when driving the structure, the distance between the brick slip grippers increases proportionally. This means that the distances between the grippers are the same over the entire construction at each stage of the driving.

In this embodiment the brick slips in the buffer can be placed against each other in line. The adjusting mechanism makes it possible for the engaging means, in particular the brick slip grippers (having or not having suction nozzles), to have the same pitch as the brick slips when they lie against each other. Depending on for instance an entered length dimension for the brick slips, a control can for instance set the engaging means to a corresponding pitch before the row of brick slips is picked up.

When the row has been picked up and is displaced to a position above the panel, the adjusting mechanism can simultaneously be driven such that the pitch between the brick slips is increased and a desired joint width is created between the brick slips. The pitch between the brick slips can optionally already be adjusted when the brick slips are still in the buffer and are still being supported.

The buffer may have at least an infeed zone for infeed of individual brick slips and a pick-up a zone for placing a row of brick slips ready for use. This means that the brick slips in a row in the pick-up zone already have the desired distances from each other, and that they are ready for picking up and placing without changing anything to the joint width. In the infeed zone, a row of brick slips may be created with the desired distances between the brick slips.

New brick slips can hereby already be placed in the infeed zone while a row of brick slips waiting in the pick-up zone still has to be picked up. The movement of the engaging means can hereby moreover be kept outside the infeed zone, so that an operative can be present at the infeed zone at all times and need not step aside every time a row of brick slips is picked up.

In yet another embodiment according to the invention the buffer comprises measuring means for measuring the dimensions of the individual brick slips.

Although the brick slips are made within determined tolerances, the dimensions of the individual brick slips will vary, certainly in the case of fired brick slips.

Due to these variations the relative joint width may be calculated and adjusted again for each row of brick slips. This can be fully automated by the use of the measuring means. If some larger bricks are present which still fall within the tolerance, this has consequences for the average joint width.

In addition, when placing the brick slips manually it is difficult to determine whether there is enough space at the end for a whole brick slip. With the measuring means it is possible to measure the dimensions of the individual brick slips and to calculate the joint width which must be applied for a proper fit.

It is therefore no longer necessary with the invention to saw bricks for a proper fit to the edge of the panel. This saves material and generates less waste.

The measured dimensions of the slips can also assist in obtaining a correct fit to recesses in the panel, such as doors and windows.

The measurements of the measuring means can also be used as selection means for ejecting brick slips which are too large. It is also possible to decide on the basis of the measurements not to place a determined row of slips because it comprises too many large bricks, whereby the joints become too narrow. By replacing determined slips in the row it is then for instance possible to form a suitable row.

With the device according to the invention the two outermost brick slips of a row will be arranged at a fixed distance from the edge of the panel. In the case of a half-brick bond the one row will be displaced half a brick slip length plus half a joint width relative to the adjacent row. The edges of a panel with brick slips can thus also be set down very accurately. If a plurality of panels are to be placed next to each other, the rows mutually engaging herein, no transition between panels will be visible in the overall formed wall owing to this precision.

Despite the precise positioning, a wholly uniform pattern will not be formed due to the small differences between the individual brick slips, whereby the panel covered with brick slips has the appearance of manually arranged bricks.

In a preferred embodiment of the device according to the invention the buffer comprises at least one mould displaceable between the infeed zone and the pick-up zone, wherein the mould comprises a number of compartments for receiving one brick slip at a time and wherein a desired distance corresponding to the desired joint width between the brick slips is provided between the adjacent compartments.

Using the mould an operative can form a row of brick slips in rapid and reliable manner, which slips are moreover positioned with the desired pitch so that a certain joint width is formed between the brick slips. This moreover ensures that after the row of brick slips is picked up it is no longer necessary to change the pitch in order to thus form a joint. This is because this is already achieved by the form of the mould.

The embodiment of the buffer can also be simpler in that the buffer needs fewer guides for placing the brick slips in a row. This is because this is provided by the mould.

The device according to the invention can not only be used for half-brick bonds, but also in more complicated patterns, particularly in the use of moulds.

In a pattern of bricks which is not a half-brick bond the bricks are arranged in different size classes, for instance a "normal brick", a brick having ¾ of the length and a brick having half the length. Patterns using such different sizes of brick can be entered into the device and when bricks of these sizes are in the buffer in the desired order, the device automatically calculates the joint width.

The supply via moulds is highly suitable for delivery of the bricks in the desired order in such patterns which are not in a half-brick bond. Seven different moulds are thus necessary for laying bricks in a random bond (wherein 1 mould is used twice within a repetitive unit).

A separate module which automatically places the bricks of different sizes in the correct order can however also be connected to the device. Such a module can for instance be a robot arm which takes the correct bricks from stacks of different bricks in the correct order.

Yet another embodiment of the invention comprises extraction means for extracting dust.

Brick slips can be dusty because sand and/or grit can be stuck thereto and can come off easily. The degree of extraction can be adjusted depending on for instance the type of brick slip (for example rough fired brick slips or smoother ceramic tile slips).

By extracting sand and grit the wear of the device is reduced. It moreover provides for a better engagement on the brick slips, particularly in the case that suction cups are used.

The invention further relates to a method for adhering brick slips to a panel, which method comprises the steps of:

positioning a panel horizontally on a horizontal surface and adjacently of a buffer zone, the panel comprising an adhesive to at least a part of the surface of the panel;

providing a row of brick slips in the buffer zone;

picking up the row of brick slips, transporting the row to a position above the panel comprising the adhesive layer and placing the row of brick slips in the adhesive layer on the panel;

providing a subsequent row of brick slips in the buffer zone;

picking up the subsequent row of brick slips, transporting the subsequent row to a position above the panel and placing the subsequent row of brick slips in the adhesive layer on the panel adjacent to the first row;

repeating the steps of 1) providing a subsequent row of brick slips and 2) picking up, transporting and placing the subsequent row of brick slips, wherein each subsequent row of brick slips is placed adjacent to the previous row in order to cover a part or the whole surface of the panel with brick slips.

wherein the joint widths of the brick slips in the rows of brick slips are adjusted from a first joint width to a second joint width before the rows are placed in the adhesive layer on the panel.

The adhesive layer is typically present on the top surface of the panel, i.e. on the side of the panel on which the brick slips will be placed.

The steps of horizontally positioning a panel and applying an adhesive to at least a part of the surface of the panel can take place in a random order, while the steps of providing a row of brick slips in the buffer zone, picking up thereof and repeating these two steps must take place in this order. Nevertheless, several rows of brick slips that are each used in different repetitions of the above steps, may be placed in the buffer zone at once. In such case, the buffer zone truly acts as a buffer.

The steps of 1) providing a subsequent row of brick slips and 2) picking up, transporting and placing the row adjacent to the previous row may be repeated a plurality of times, for example until there is no more space on the panel for a subsequent row. It may for example be repeated at least 10 times, at least 20 times or at least 30 times.

In a method of the invention, the adjusting of the joint width of the brick slips may occur in the buffer zone or during the transporting of the row to a position above the panel.

In a method of the invention, the adjusting from a first joint width to a second joint width may be performed by means of a mould when the brick slips are in the buffer zone, for example a mould comprising a number of compartments for receiving one brick slip at a time and wherein a desired distance corresponding to the desired joint width between the brick slips is provided between the adjacent compartments.

The adjusting may also be performed during the transporting of the row to a position above the panel, by means of a mechanism capable of displacing the brick slip grippers independently of each other (for example separate brick slip grippers that can be driven independently of each other), so that the distance between the brick slip grippers (and the distance between the brick slips themselves) can be adjusted.

The adjusting may be performed with at least two different results. In a first way of adjusting, the joint widths of the brick slips in the row are substantially the same. In a second way, the centre-to-centre distances of the brick slips in the row are substantially the same. In the latter case, an incidentally large brick slip has two relatively small joint widths on either side.

An additional advantage of positioning the panel on a horizontal transport surface is that after the brick slips are arranged a liquid joint material can be poured between the slips, which material can then cure to form joints.

It is further possible also to arrange one or more brick slips at a right angle to the direction of the row, and optionally to arrange a row of such brick slips (such as for instance a soldier course). This can be done by positioning the brick slips in the buffer in this way (i.e. the long side of the brick slip is then at a right angle to the direction of the row), or by rotating the brick slips through 90° after they have been picked up. It is also possible to rotate the panel, preferably through 90°, after a previously arranged row of brick slips has been arranged. The next brick slip which is then placed is at a right angle to the previously arranged row of brick slips. The brick slips are in this way oriented in the same direction while situated in the buffer and while being picked up as during placing of the previous row of brick slips.

In a preferred embodiment of the method according to the invention the panel is a plate of an insulating foam.

These and other features of the invention are further elucidated with reference to the accompanying drawings.

Figure 1:
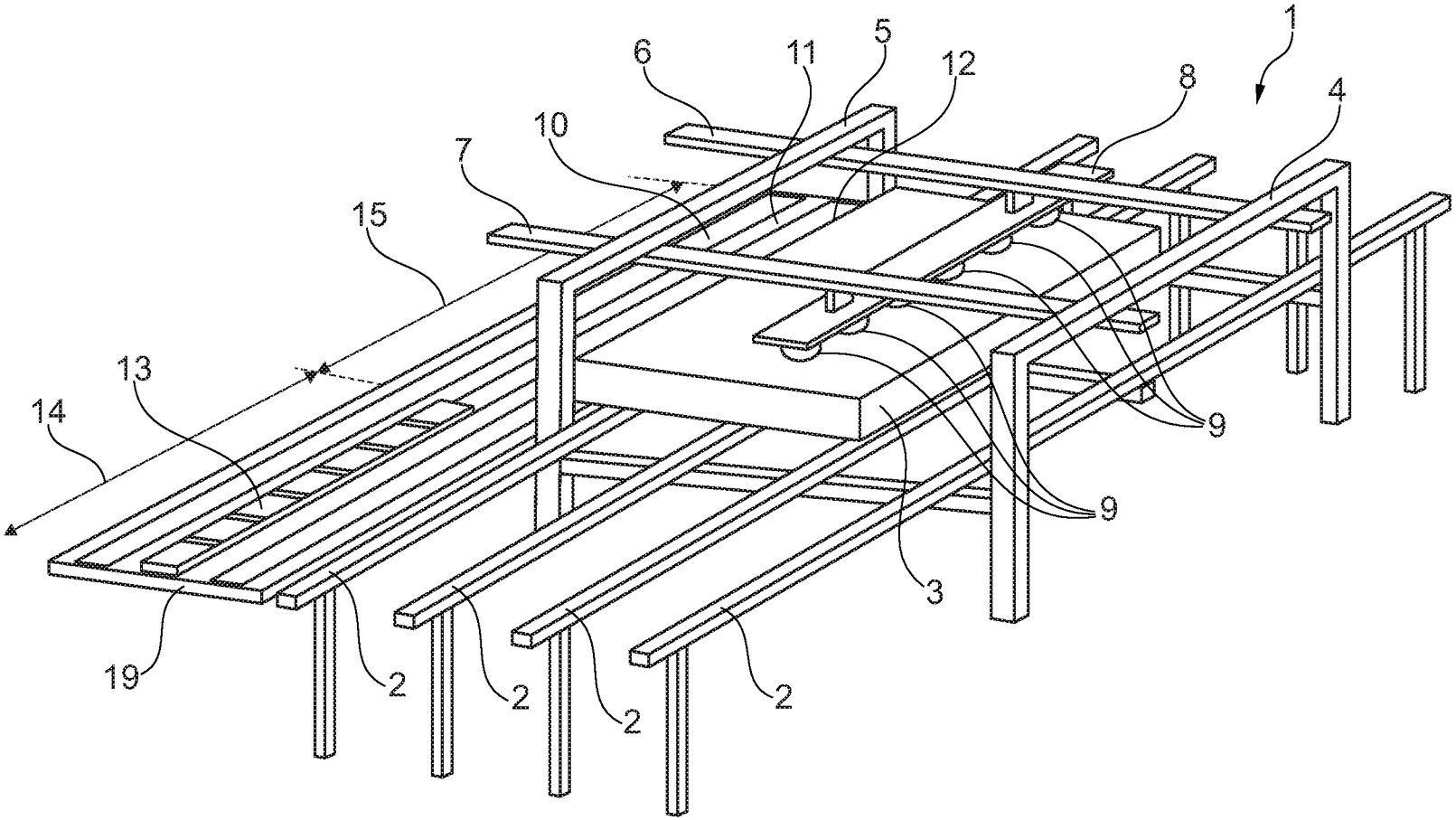
FIG. 1 shows a perspective view of an embodiment of the device according to the invention.

FIG. 1 shows a device 1 according to the invention. Device 1 has a transport surface which is formed by roller tracks 2. A panel 3 is transported on this transport surface 2 from an infeed side, on the front side in the figure, to the centre of transport surface 2.

Two gantries 4, 5 from which are suspended two guide rails 6, 7 are placed at the position of the centre of transport surface 2. Engaging means 8 are guided and displaceable along these guide rails 6, 7. Engaging means 8 are provided with a large number of suction cups 9 with which brick slips can be picked up.

Provided adjacently of transport surface 2 is a buffer which has a buffer table 19. Provided on this buffer table 19 are three tracks 10, 11, 12 along which moulds 13 can be slid.

FIG. 1 shows mould 13 in infeed zone 14. When mould 13 is filled with brick slips, mould 13 can be slid via a track 11 to pick-up zone 15 where engaging means 8, 9 can pick up the brick slips from mould 13.

Figure 2:
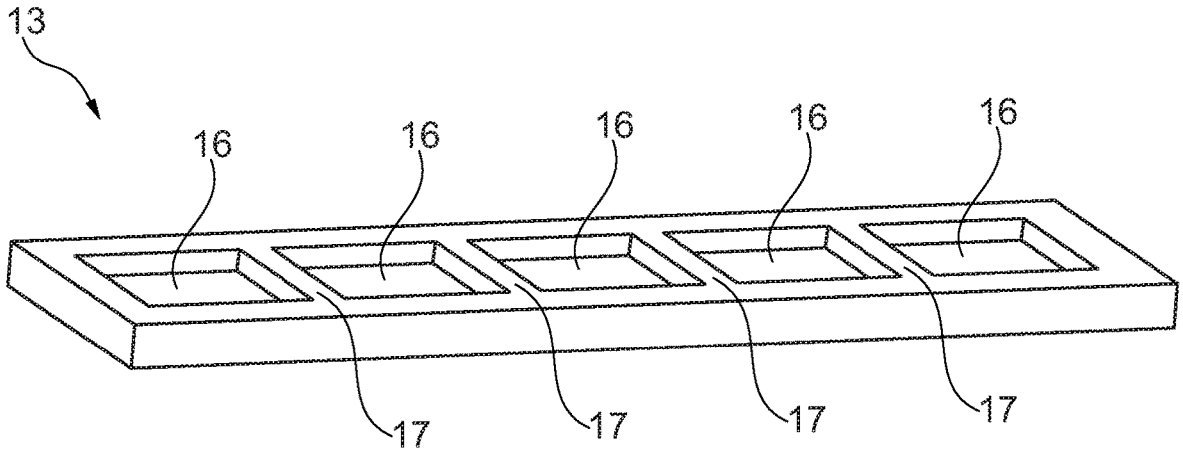
FIG. 2 shows a perspective view of a mould for the buffer of the device according to FIG. 1.

FIG. 2 shows mould 13 in perspective view. Mould 13 is an elongate body with a number of compartments 16, arranged one behind the other, in which one brick slip at a time can be received. Because compartments 16 are mutually separated by walls 17 the correct spacing of the brick slips placed therein, which corresponds to the desired joint width, is obtained at the same time.

Figure 3:
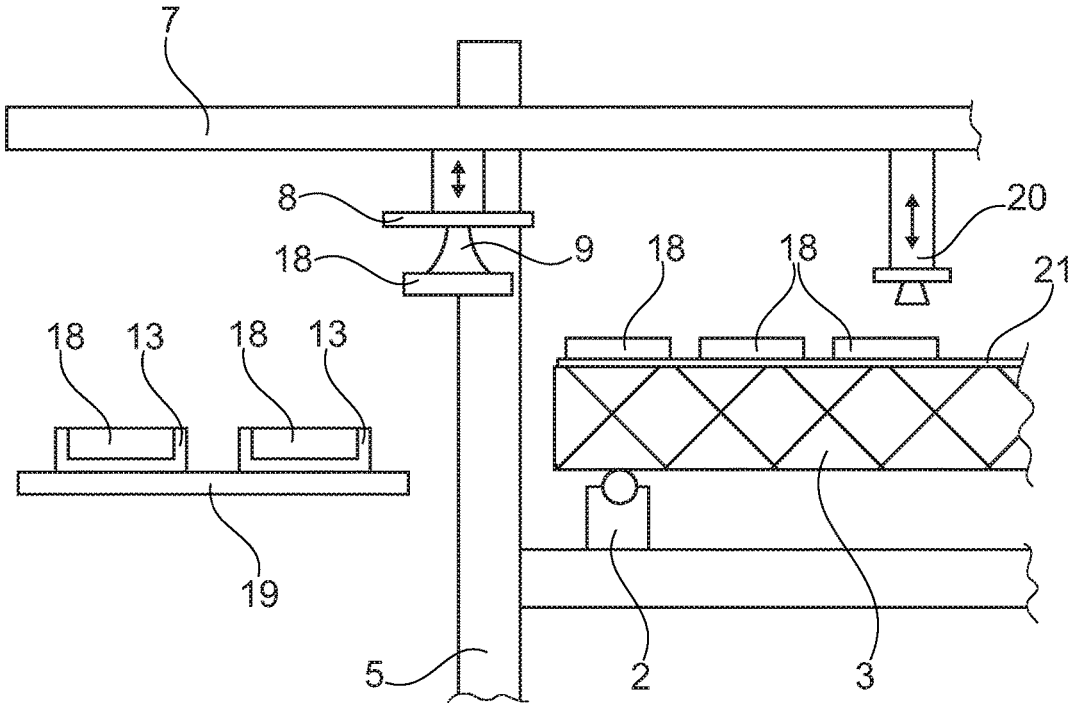
FIG. 3 shows a side view of the device according to FIG. 1.

FIG. 3 shows a side view of device 1. Provided on buffer table 19 are two moulds 13 which are filled with brick slips 18. Engaging means 8, 9 take the brick slips 18 with the correct pitch distance out of moulds 13 from the position above buffer table 19 and displace these brick slips 18 along guide rail 7 to a position above panel 3. A separate adhesive dispenser 20 is also displaceable along guide rails 6, 7. A layer of adhesive 21 can be applied to panel 3 with this adhesive dispenser 20 before engaging means 8, 9 press the picked-up row of brick slips 18 into adhesive layer 21 on panel 3.

A panel 3 can in this way be provided with rows of brick slips 18 in simple, rapid and reliable manner in order to thus wholly cover panel 3 therewith.

Figure 4:
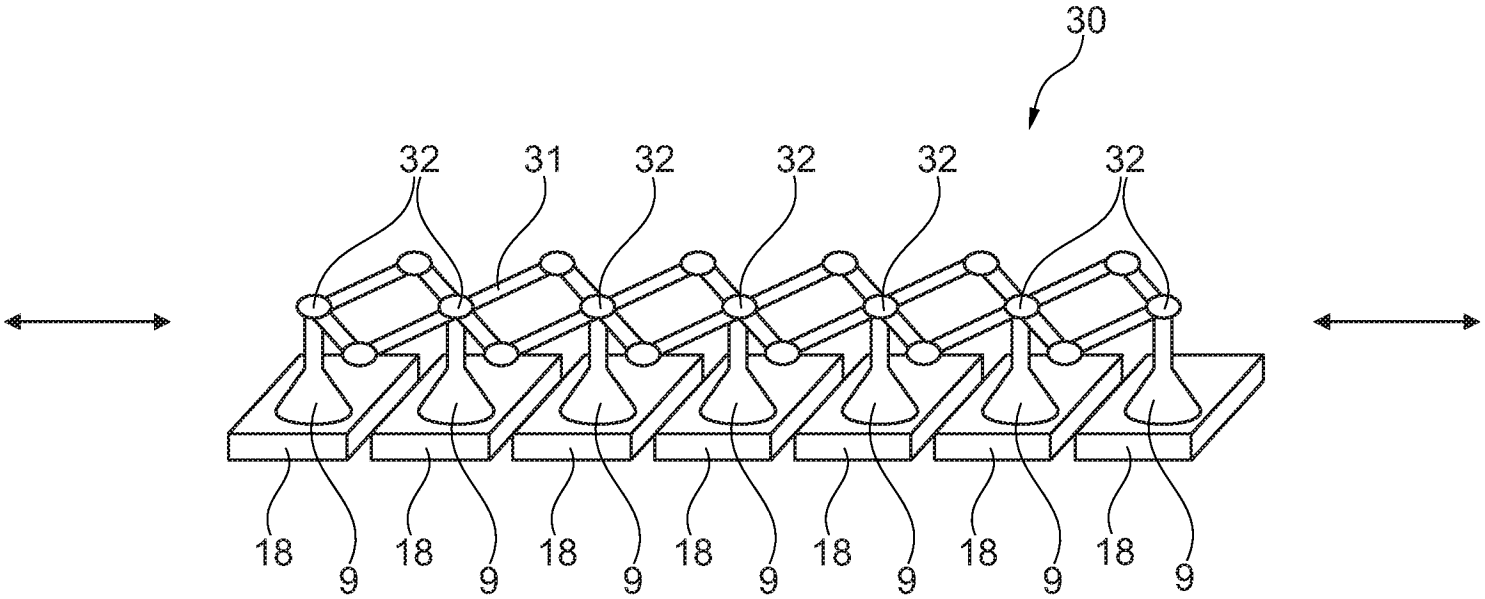
FIG. 4 shows an alternative embodiment of the engaging means for a device according to FIG. 1.

FIG. 4 shows an alternative 30 to the engaging means for device 1 according to FIG. 1. Engaging means 30 are provided with a multi-scissor construction 31. Mounted on pivot points 32 are suction cups 9, so that the distance between brick slips 18 can be adjusted by driving multi-scissor construction 31. Moulds 13 can hereby be omitted and brick slips 18 can be placed in the buffer lying against each other

The invention claimed is:

1. A device for adhering brick slips to a panel, wherein the device comprises:

a horizontal transport surface with an infeed side and an outfeed side for transporting the panel from the infeed side, over the transport surface and to the outfeed side, the transport surface having a longitudinal dimension extending along a direction of transporting from the infeed side to the outfeed side and having a transverse dimension perpendicular to the longitudinal dimension;

a buffer arranged adjacently of the transport surface for buffering at least one row of brick slips; and engaging means displaceable between a position above the buffer and a position above the transport surface capable of picking up from the buffer the at least one row of brick slips and placing the row of brick slips on the panel, wherein the engaging means 1) comprise a plurality of brick slip grippers, wherein a brick slip gripper is a gripper capable of holding a brick slip;

2) are displaceable above the horizontal transport surface in the transverse dimension of the horizontal transport surface so that the device is capable of placing a first row of brick slips on the panel and also capable of placing at least a second row of brick slips on the panel, wherein the second row is adjacent to the first row;

wherein the device comprises means for adjusting joint widths of the brick slips in a row of brick slips from a first joint width to a second joint width.

2. The device as claimed in claim 1, further comprising a gantry guide which extends over the buffer and the transport surface and wherein the engaging means are arranged on the gantry guide.

3. The device as claimed in claim 1, wherein the brick slip grippers comprise suction nozzles for holding a brick slip by means of suction.

4. The device as claimed claim 1, wherein the transverse dimension is at least one meter.

5. The device as claimed in claim 1, which is capable of placing at least ten adjacent rows of brick slips on the panel.

6. The device in claim 1, wherein the engaging means comprise a driven adjusting mechanism capable of displacing the brick slip grippers independently of each other, so that a distance between the brick slip grippers can be adjusted.

7. The device as claimed in claim 6, wherein the driven adjusting mechanism comprises a multi-scissor construction comprising a plurality of pivot points, wherein the brick slip grippers are mounted on the pivot points, so that the distance between brick slip grippers can be adjusted by driving the multi-scissor construction.

8. The device as claimed in claim 1, wherein the buffer has at least an infeed zone for infeed of individual brick slips and a pick-up a zone for placing a row of brick slips ready for use.

9. The device as claimed in claim 8, wherein the butter comprises at least one mould displaceable between the infeed zone and the pick-up zone, wherein the mould comprises a number of compartments for receiving one brick slip at a time and wherein a desired distance corresponding to a desired joint width between the brick slips is provided between the adjacent compartments.

10. The device as claimed claim 1, further comprising extraction means for extracting dust.

11. The device as claimed in claim 1, further comprising dispensing means for dispensing a layer of adhesive onto the panel.

12. The device as claimed in claim 1, wherein the device, in particular the buffer or the engaging means, comprises measuring means for measuring dimensions of the individual brick slips.

13. A method for adhering brick slips to a panel, wherein the method comprises the steps of:

positioning a panel horizontally on a horizontal surface and adjacently of a buffer zone, the panel comprising an adhesive layer to at least a part of a surface of the panel;

providing a row of brick slips in the buffer zone;

picking up the row of brick slips, transporting the row to a position above the panel comprising the adhesive layer and placing the row of brick slips in the adhesive layer on the panel;

providing a subsequent row of brick slips in the buffer zone;

picking up the subsequent row of brick slips, transporting the subsequent row to a position above the panel and placing the subsequent row of brick slips in the adhesive layer on the panel adjacent to the first row;

repeating the steps of 1) providing a subsequent row of brick slips and 2) picking up, transporting and placing the subsequent row of brick slips, wherein each subsequent row of brick slips is placed adjacent to a previous row in order to cover a part or the whole surface of the panel with brick slips, wherein joint widths of the brick slips in the rows of brick slips are adjusted from a first joint width to a second joint width before the rows are placed in the adhesive layer on the panel.

14. A method as claimed in claim 13, wherein during the adjustment of the joint width of the brick slips occurs in the buffer zone or during the transporting of the row to a position above the panel.

15. A method as claimed in claim 13, wherein the joint widths of the brick slips in the row are substantially the same upon placement on the panel, or wherein the centre-to-centre distances of the brick slips in the row are substantially the same upon placement on the panel.

* * * * *